US006280856B1

(12) United States Patent
Andersen et al.

(10) Patent No.: US 6,280,856 B1
(45) **Date of Patent: *Aug. 28, 2001**

(54) DEFORMABLE ROOF FLASHING MATERIAL AND A METHOD OF MANUFACTURING SUCH A MATERIAL

(75) Inventors: Susanne Bjergegaard Andersen; Per Jacobsen, both of Horsens (DK)

(73) Assignee: V. Kann Rasmussen Industri A/S, Soborg (DK)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/722,234

(22) PCT Filed: Apr. 7, 1995

(86) PCT No.: PCT/DK95/00150

§ 371 Date: Oct. 11, 1996

§ 102(e) Date: Oct. 11, 1996

(87) PCT Pub. No.: WO95/28536

PCT Pub. Date: Oct. 26, 1995

(30) Foreign Application Priority Data

Apr. 15, 1994 (DK) ..... 0441/94

(51) Int. Cl.[7] ..... B32B 3/12; B32B 3/28; B21B 1/04; E04D 1/36

(52) U.S. Cl. ..... 428/593; 428/595; 428/604; 428/650; 428/654; 428/181; 428/182; 428/183; 428/184; 428/185; 428/926; 72/177; 72/187; 72/196; 52/58

(58) Field of Search ..... 428/593, 595, 428/604, 650, 654, 926, 183, 185, 182, 184, 181; 72/177, 187, 196; 52/58

(56) References Cited

U.S. PATENT DOCUMENTS

| | | | | |
|---|---|---|---|---|
| 1,450,351 | * | 4/1923 | Beran | 72/177 |
| 3,034,212 | * | 5/1962 | Reifers | 29/553 |
| 3,395,438 | * | 8/1968 | Seeff | 29/183 |
| 4,380,573 | * | 4/1983 | Naslund | 428/595 |
| 4,594,818 | * | 6/1986 | Prestidge | 52/58 |
| 5,946,862 | * | 9/1999 | Hoffman | 52/58 |

FOREIGN PATENT DOCUMENTS

| | | |
|---|---|---|
| 1809818 | 8/1969 | (DE) . |
| 0038222 | 10/1981 | (EP) . |
| 959824 | 10/1949 | (FR) . |
| 1243338 | 8/1971 | (GB) . |
| 376454 | 4/1973 | (SE) . |

* cited by examiner

*Primary Examiner*—Paul Thibodeau
*Assistant Examiner*—Holly C. Rickman
(74) *Attorney, Agent, or Firm*—Venable; John P. Shannon; Chad Anderson

(57) ABSTRACT

A deformable sheet material at least partly comprising a sheet metal or metal foil which is corrugated, e.g. by rolling, in continuous waveform in two directions (A, B) substantially orthogonal to each other. The sheet material can comprise aluminum foil with a thickness between 0.005–0.4 mm designed as a ribbon or a strip which prior to the rolling is folded in the longitudinal direction where an intermediate layer, e.g. of aluminum, can be placed between the two material layers.

13 Claims, 2 Drawing Sheets

DEFORMABLE ROOF FLASHING MATERIAL AND A METHOD OF MANUFACTURING SUCH A MATERIAL

Figure 1:
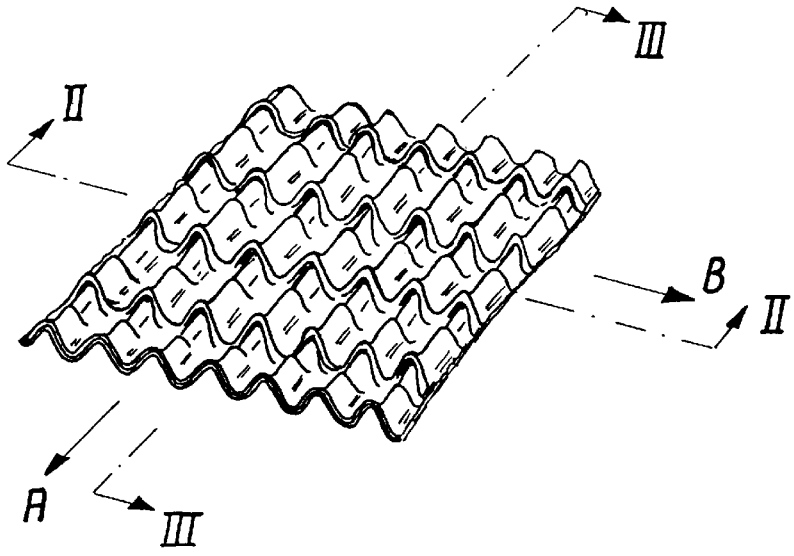

The invention relates to a deformable root flashing material for use in connection with roof windows and similar roof penetrating building structures consisting at least partly of a metal sheet or a metal foil in the form of a ribbon or a strip, one long side of which is intended for connection with the roof penetrating building structure, said ribbon or strip being corrugated in a continuous waveform.

Such deformable sheet materials are frequently used to provide water- and snowproof adaptations between roof penetrating building structures, especially roof windows, and the surrounding roofing which may consist of tiles or other forms of corrugated covering materials.

In order to permit an adaptation of such flashing materials to the form of the surrounding roof covering by a purely manual deformation, the use of corrugated roofing materials of above-mentioned type made from lead or other forms of deformable metal foil as disclosed in, inter alia, DE utility model G 82 00 019.0, has in course of time also been proposed to replace the flat lead skirts with a thickness of 1–2 mm and originally used for this purpose Concurrently with increasing concern of the environment, it has further been suggested to use a number of different sandwich or composite materials including those disclosed in the applicant's DK patents nos. 148.064 and 165.014 and EP patents nos. 0 038 222 and 0 123 141, in order to avoid the pollution problems related to the use of lead.

However, such sandwich materials have as a rule been considerably more expensive than pure lead flashings. Furthermore, both per se and as a consequence of their incorporation in a sandwich material together with partly elastomeric materials, the used metal foils have not always had the required lasting deformation properties because of a certain remaining elastic resilience.

Based on corrugated flashing materials of the type disclosed in above DE utility model, it is the object of the invention to procure a new design of a flashing material which can be produced at a low price and has deformation properties fully up to the standard of those of the best sandwich materials.

To this end, a flashing material of the above type according to the invention is characterized in that said ribbon or strip is corrugated in a continuous waveform in two directions substantially orthogonal to each other.

The double waveform of the flashing material according to the invention entails that the area of the metal sheet or foil per unit area of the finished flashing material is substantially increased, which is decisive for an easy manual deformability by the stretching of the crests and valleys of the waveform without necessarily stretching or butting the very foil material.

As an appropriate foil material according to the invention, an aluminium foil having a thickness preferably between 0.05 and 0.4 mm may be used. However, other forms of metal foils with good plastic deformation properties, eg. copper or zinc, may also be used.

Moreover, according to the invention, it appeared that particularly good lasting deformation properties practically without resilience and at the same time an improved strength arid rigidity can be obtained by using two folded, up metal foil layers with a relatively small thickness.

A preferred embodiment is therefore according to the invention characterized in that prior to the corrugation in said waveform, the ribbon or strip is folded in the longitudinal direction along a folding line placed substantially halfway between the two opposite long sides.

In sheet materials for roofing where, unlike easily deformable flashing materials of the type to which this invention relates, importance has to be attached to high strength and stiffness in combination with a low net weight and a certain ability to absorb limited movements as a result of thermal expansion, it is in itself known from SE published specification No. 376454, DE-OS No. 1809878 and FR patent No. 959824 to provide the sheet material with a double corrugation in directions which are orthogonal to each other.

On the basis of this prior art the invention furthermore relates to a method of manufacturing a sheet material as indicated above, in which a ribbon or a strip consisting at least partly of metal sheet or metal foil is corrugated by rolling in a first direction for production of a first continuous waveform. According to the invention, said method is characterized in that after rolling in said first direction said ribbon or strip is corrugated in a second waveform substantially orthogonal to the first by rolling in a second direction substantially orthogonal to said first direction.

Figure 2:
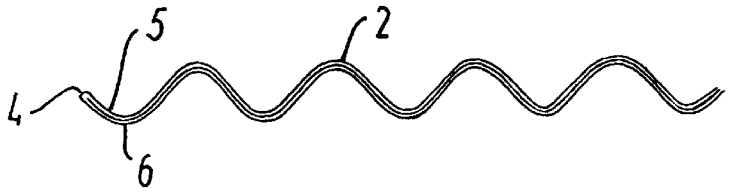
Figure 3:
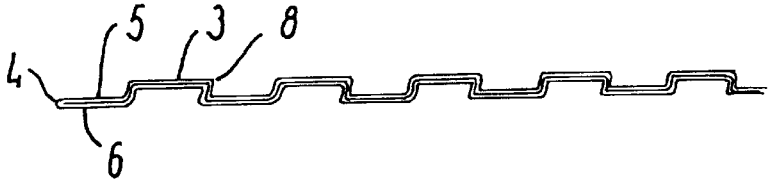
Figure 4:
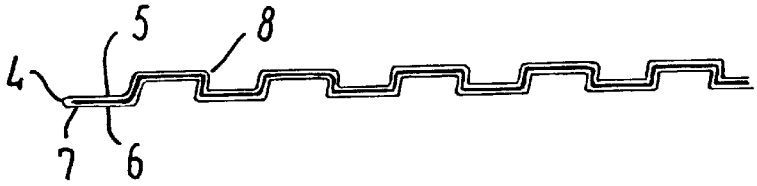
Figure 5:
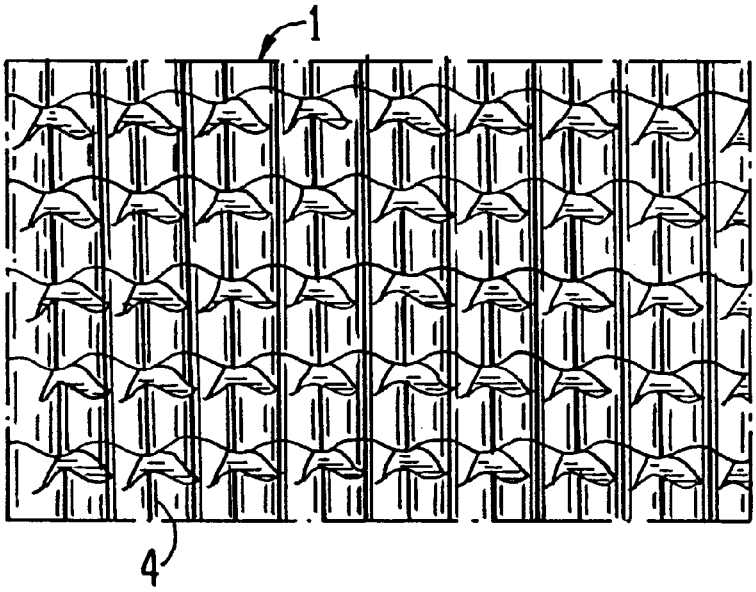
Figure 6:
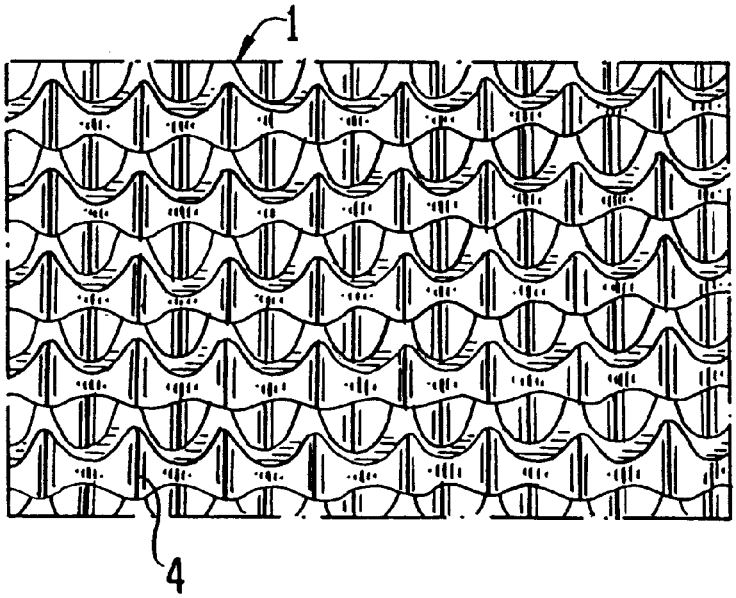

In the following the invention will be explained in more detail with reference to the schematic drawing where FIG. 1 shows in perspective a section of a strip-shaped flashing material for a roof window, FIGS. 2 and 3 are enlarged sectional views along the lines II—II and III—III in FIG. 1, FIG. 4 is a modification of the waveform shown in the sectional view of FIG. 3, and FIGS. 5 and 6 are plane views corresponding to the sectional views shown in FIGS. 3 and 4, respectively.

In the embodiments shown in the drawing, the flashing material according to the invention consists of aluminium foil preferably having a thickness between 0.05 and 0.4 mm, eg. 0.1 mm, shaped in the form of a ribbon or a strip 1 with a width of eg. 15–20 cm to be fastened to a conventional roof window as explained eg. in the applicant's DK patent no. 151.112.

According to the invention, this foil material is corrugated in a continuous waveform in two directions orthogonal to each other by two consecutive rolling operations in the directions shown by the arrows A and B in FIG. 1.

By the first rolling operation in the direction A which is preferably the cross direction of the ribbon or the strip 1, the material in the shown embodiments is corrugated in a continuous waveform with substantially S-shaped waves with wave crests 2 as shown in FIG. 2 when passing through one or more section rolling stations.

The subsequent rolling in the direction B which is preferably the longitudinal direction of the ribbon 1, may be performed in the same or a corresponding rolling installation, ie. with the same form of wave profile with wave crests 3 as shown in FIG. 3.

A possible cold setting caused by one or both rolling operations is relatively easily removed by annealing.

However, the corrugation in the two rolling operations need not be the same. Thus, as eg. shown in FIG. 4, an asymmetrical waveform with another amplitude and wavelength than in the first rolling operation can be provided in the second rolling operation.

By the shown embodiments, the ribbon- or strip-shaped material is, prior to the rolling operations, folded along a folding line 4 substantially halfway between the two opposite long sides of the ribbon in such a way that the folded flashing will comprise two folded up foil layers 5 and 6, as it appears from FIGS. 2–4. In the first place, a completely closed free lower edge at the folding line is thus obtained for a strip-shaped flashing of a roof window. Secondly, the manual deformability appeared to be improved by using the two relatively thin folded up foil layers instead of one layer with the double thickness. Furthermore, it appeared that such a folded flashing material is practically free from resilience and can thus be brought into quite close abutment with the surrounding roofing independently of its surface form.

As the corrugation causes a certain locking effect between the two folded up foil layers 5 and 6 in connection with the forming of the flashing against the roofing, an improved stiffness is further obtained. In particular, the second rolling operation results in an efficient lock between the foil layers, as the wave crests are deformed in the rolling direction such that the foil layers are backfolded at one end of the wave crest marked by 8 in FIGS. 3 and 4.

As shown in FIG. 4, an intermediate layer 7 can be placed between the two folded up foil layers 5 and 6. Such an intermediate layer may be an aluminium foil with the same or another thickness than the layers 5 and 6 or it may be of a completely different material, eg. an adhesive or non-adhesive thermoplastic material. The flashing material according to the invention can hereby be manufactured with the required properties as to eg. strength, deformability and weight.

The finished flashing material may be applied with lacquer in a usual manner or coated in another way in order to obtain an improved weatherproofness and eg. chromatic adaptation to the surroundings.

What is claimed is:

1. A deformable roof flashing member for use in connection with roof windows and similar roof penetrating building structures, comprising a ribbon or strip, one long side of which is intended for connection with the roof penetrating building structure, said ribbon or strip comprising at least partly a manually deformable metal sheet or foil corrugated in a continuous waveform, characterized in that the ribbon or strip comprises at least two overlying layers of said metal sheet or foil, each of which is corrugated in a continuous waveform in two directions substantially orthogonal to each other.

2. A roof flashing member according to claim 1, characterized in that the two overlying layers are provided by folding the ribbon or strip in its longitudinal direction along a folding line substantially halfway between two opposite long sides.

3. A roof flashing member according to claim 2, characterized in that an intermediate layer is placed between said overlying layers.

4. A roof flashing member according to claim 1, characterized in that the waveforms in the two directions substantially orthogonal to each other possess substantially the same amplitude and wavelength.

5. A roof flashing member according to claim 1, characterized in that the waveform in one of the two directions is asymmetrical and different from the waveform in the other direction.

6. A roof flashing member according to claim 1, characterized in that said metal sheet or foil is aluminum foil.

7. A roof flashing member according to claim 1, characterized in that said metal sheet or foil has a thickness between 0.05 and 0.4 mm.

8. A roof flashing member according to claim 3, characterized in that said intermediate layer also comprises aluminum foil.

9. A roof flashing member according to claim 1, characterized in that the roof flashing member is provided with a weatherproof surface coating.

10. A roof flashing member according to claim 1, characterized in that the roof flashing member is provided with a chromatic adapting surface coating.

11. A method of manufacturing a roof flashing member according to claim 2, comprising the step of rolling said ribbon or strip comprising said overlying layers in a first direction for production of a first continuous waveform, characterized in that, after said rolling in said first direction, said ribbon or strip is rolled in a second direction substantially orthogonal to said first direction to produce a second continuous waveform substantially orthogonal to said first direction.

12. A method of manufacturing a roof flashing member accordingly to claim 11, characterized in that, prior to rolling in said first and second directions, a single layer ribbon or strip is folded in its longitudinal direction along a folding line substantially halfway between two opposite long sides to produce two overlying layers.

13. A method of manufacturing according to claim 12, characterized in that an intermediate layer is placed between said overlying layers of said folded ribbon or strip.

* * * * *